United States Patent [19]

Bezama et al.

[11] Patent Number: 4,684,339

[45] Date of Patent: Aug. 4, 1987

[54] GAS-LOADED PRESSURE DIAPHRAGM

[75] Inventors: Raschid J. Bezama, Mahopac; Charles H. Perry, Poughkeepsie, both of N.Y.

[73] Assignee: International Business Machines Corporation, Armonk, N.Y.

[21] Appl. No.: 873,906

[22] Filed: Jun. 13, 1986

[51] Int. Cl.[4] ..... B30B 5/02

[52] U.S. Cl. ..... 425/389; 100/269 A; 425/406; 425/457; 425/DIG. 110

[58] Field of Search ..... 249/65; 425/33, 40, 425/51, 405 R, 405 H, 406, 407, 411, 457, 383, 384, 389, 390, DIG. 14, DIG. 19, DIG. 110, DIG. 112, DIG. 44; 100/211, 269 A, 93 P; 264/56, 60, 64–66; 156/145, 583.1

[56] References Cited

U.S. PATENT DOCUMENTS

| | | | |
|---|---|---|---|
| 2,373,770 | 4/1945 | Martin | 100/269 A |
| 3,383,737 | 5/1968 | Gregor | 425/406 |
| 3,523,148 | 8/1970 | Boyer et al. | 264/570 |
| 3,879,509 | 4/1975 | Elderbaum | 265/56 |
| 4,009,238 | 2/1977 | Niedermeier et al. | 264/61 |
| 4,156,589 | 5/1979 | Schmitt et al. | 425/389 |
| 4,190,484 | 2/1980 | Pohl | 100/269 A |
| 4,264,556 | 4/1981 | Kumar et al. | 425/405 H |

OTHER PUBLICATIONS

IBM Technical Disclosure Bulletin, vol. 23, No. 5, Oct. 1980.

*Primary Examiner*—Jay H. Woo
*Assistant Examiner*—J. Fortenberry
*Attorney, Agent, or Firm*—William T. Ellis

[57] ABSTRACT

A gas-loaded diaphragm for exerting a predetermined pressure on a ceramic substrate during sintering to prevent x-y shrinkage. In the most preferred embodiment, the diaphragm comprises a gas-filled base composed of two opposing discs, and a substantially hollow gas-filled toroid container disposed around the perimeter of the opposing discs and communicating therewith to permit gas flow therebetween. This diaphragm is disposed in relation to a ceramic substrate-containing cell so that when it is heated to a desired temperature, the gas in the diaphragm expands and forces the two opposing discs apart to thereby exert a predetermined pressure on the ceramic substrate-containing cell.

11 Claims, 3 Drawing Figures

GAS-LOADED PRESSURE DIAPHRAGM

BACKGROUND OF THE INVENTION

The present invention relates generally to the fabrication of ceramic sheets, and more particularly to an apparatus for applying a force to these ceramic sheets while they are being fired to prevent shrinkage, distortion, and camber.

Ceramic sheets are of particular importance in the electronics industry for the packaging/mounting of semiconductor integrated devices and other elements. The fabrication of such ceramic substrates generally is well known and entails mixing of the ceramic with a binder and various solvents, casting the "green" sheets of this ceramic mixture, drying the green sheets, blanking and punching via holes in the sheets, screening metallurgy into the via holes, stacking and laminating these sheets, firing these laminated sheets, and finally sintering the resulting laminated structure. The details for these various processing steps are set forth in U.S. Pat. Nos. 3,423,517; 3,723,276; 4,340,436; 4,234,367; and 4,301,324.

Of particular concern in processing these ceramic structures is the shrinkage and distortion which the ceramic structure undergoes during sintering. The cohesive forces which operate during sintering cause reproducible shrinkage in the x-y plane, non-linear x-y plane shrinkage, as well as via bulge and curvature in the z direction, referred to as camber. It is particularly important to control the x-y plane shrinkage because the dimensions for the x-y plane determine the location for the chips to be disposed on the ceramic substrate. Additionally, precise x-y plane dimensional control is essential to permit the use of automated wire bonders and automated testers.

Various methods for reducing the effects of x-y plane shrinkage and z-direction distortion have been proposed in the art. A typical distortion reduction method is disclosed in U.S. Pat. No. 4,009,238 which teaches the use of applied pressure by means of compression rams to the substrate surface during the sintering step, which is the processing step when most of the x-y plane shrinkage and distortion occurs. The application of this weight or force on the substrate during sintering operates to balance or counteract the cohesive forces of sintering and forces any shrinkage to occur only in the z direction (the thickness direction for the substrate). Accordingly, ceramic substrates sintered with the above-described loading thereon are flat with minimal x-y plane shrinkage. However, the standard method for applying force or loading to the substrate during sintering is to use a large weight with an attendant large thermal mass on the substrate. Such weights are cumbersome to move on a standard ceramic substrate conveyor belt. Additionally, because of their large thermal mass, these weights require a significant amount of time and energy to heat to the required sintering temperature. Typically, the required time for sintering is doubled with the use of such weights disposed on the substrate. A further problem with such weights is that their use requires the reservation of a certain volume above the substrate, thereby limiting the thickness of the ceramic product which can be sintered in a given furnace. Yet a further problem with the use of such weights is that they have a high center of gravity, thereby causing stability problems during conveyance to and from the sintering furnace.

The invention as claimed is intended to remedy the above-described problems with current techniques for ceramic substrate loading during sintering.

The advantages offered by the present invention are that ceramic substrate loading can be obtained with a low thermal mass device which can be heated quickly in a sintering oven, thereby significantly reducing the sintering time and energy required. Likewise, the device of the present invention has a very small volume and a low center of gravity, so that it does not limit the thickness of the product being sintered, and does not cause stability problems during the conveyance of the product to and from the sintering oven.

SUMMARY OF THE INVENTION

Briefly, the present invention is an apparatus for use in a frame structure to apply pressure to a substrate-containing cell during a heating cycle, comprising;

a sealed, substantially hollow gas-filled diaphragm including a planar hollow gas-filled base with two opposing approximately planar major surfaces, and a substantially hollow gas-filled container with at least one cross-section thereof having at least one substantially circular area connected to communicate with the hollow base so that gas can flow therebetween, This gas-filled diaphragm is disposed in relation to the substrate-containing cell so that when the diaphragm is heated to a desired temperature, the gas in the diaphragm expands and forces the two opposing planar major surfaces of the base apart to thereby exert a predetermined pressure on the substrate-containing cell.

In one embodiment of the present invention, the diaphragm may include at least one cross-section thereof with two substantially circular areas disposed at and communicating with opposite ends of the planar base.

In a further embodiment of the present invention, the hollow container may be disposed around and connected to the perimeter of the planar major surfaces of the base to thereby communicate with the base around the perimeter thereof.

The frame structure for the present invention may include a first and a second opposing planar surfaces, with the first surface being adapted for holding one of the major surfaces of the substrate-containing cell thereon, and with one of the two planar major surfaces of the base in contact with the second opposing planar surface of the frame structure, but being disposed so that the hollow container is not in contact with the frame structure. In a preferred embodiment, the frame structure may comprise an outer frame structure with the second planar surface disposed on a first pedestal therefrom; and a second pedestal disposed between the other of the major surfaces of a substrate-containing cell and the other of the two planar major surfaces of the base, but disposed so that it is not in contact with the hollow container.

In one embodiment of the present invention, the sealed gas-filled diaphragm may contain a gas therein which at room temperature has a pressure which is higher than atmospheric pressure.

In a preferred embodiment of the present invention, the two opposing planar major surfaces of the base may comprise opposing planar discs, and the hollow container may comprise a toroid disposed around and connected to the perimeters of the discs to thereby communicate with the base around the perimeter thereof.

BRIEF DESCRIPTION OF THE DRAWINGS

The subject invention will be described in greater detail with reference to the drawings wherein.

DETAILED DESCRIPTION OF THE PREFERRED EMBODIMENT

The present invention comprises an apparatus for applying pressure to a substrate-containing cell during a heating cycle by means of gas pressure. More specifically, the present apparatus is designed to minimize volume change of the apparatus with changes in temperature, so that pressure is essentially directly proportional to the temperature. This volume change minimization is effected by utilizing a design wherein the majority of the volume of the gas to be expanded is located in a gas container which has at least one cross section thereof which is essentially circular. The circularity of this gas container cross-section ensures that there is minimal volume change with change in temperature. The actual pressure-exerting area for the apparatus is designed to have a small gas volume to provide for minimal deformation during temperature changes. This design ensures that the pressure exerted by this pressure-exerting area is essentially proportional to the change in temperature.

Figure 1A:
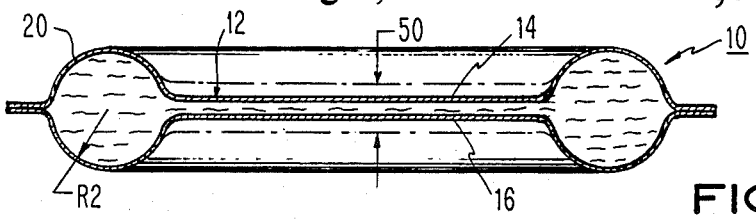
FIG. 1A is a cross-sectioned side view of a preferred embodiment of the pressure-applying apparatus of the present invention.
Figure 1B:
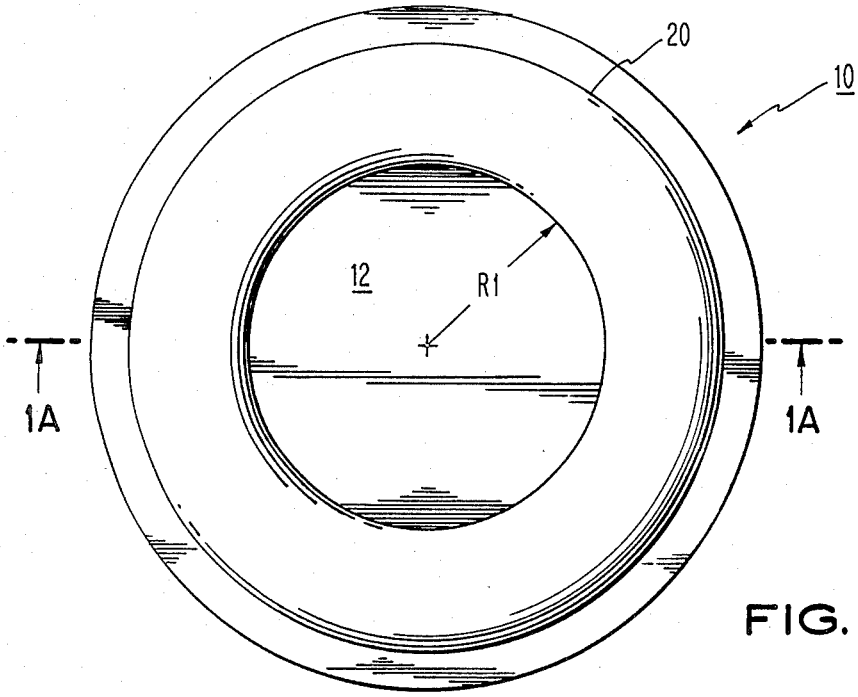
FIG. 1B is a top view of the apparatus shown in FIG. 1A.

FIGS. 1A–B show a preferred embodiment of the present invention. The apparatus of the present invention comprises a sealed, substantially hollow gas-filled diaphragm 10. The diaphragm 10 comprises a planar hollow gas-filled base 12 with two opposing approximately planar major surfaces 14 and 16, in combination with a substantially hollow gas-filled container 20 with at least one cross-section thereof having at least one substantially circular area connected to communicate with the hollow base 12 so that gas can flow therebetween.

The planar base 12 may take a variety of geometries such as circular or disc-shaped, square, rectangular, triangular, etc. Likewise, the hollow container 20 may take a variety of configurations, so long as at least one cross-section thereof is circular. In one embodiment, this hollow container 20 may have two substantially circular areas disposed at and communicating with opposite ends of the planar base 12. It is preferred that this hollow container 20 be disposed around and connected to the perimeter of the planar major surfaces 14 and 16 of the base 12 to thereby communicate with the base 12 around the perimeter thereof.

In a preferred embodiment of the diaphragm 10, the two opposing planar major surfaces 14 and 16 of the base 12 comprise opposing planar discs as shown in FIG. 1, and the hollow container 20 is substantially in the shape of a toroid disposed around and connected to the perimeters of the discs 14 and 16 to thereby communicate with the base 10 around the perimeter thereof. This structure may be viewed as two symmetrical discs with grooves formed therein around the perimeter thereof. These metal discs may be formed from stainless steel or any corrosion resistant material.

The diaphragm 10 is filled with a gas which will expand and exert an increasing pressure with increasing temperature. It is preferred that this gas be some form of inert gas such as nitrogen, or argon to ensure that if any leaks in the diaphragm occur, that the leaking gas does not cause oxidation or reduction of the substrate being sintered.

Typically, the diaphragm 10 will be filled with gas at standard atmospheric pressure, i.e., 1 atmosphere, and at room temperature. However, it may be desirable to inject a gas into the diaphragm 10 at a higher pressure to thereby tailor the ultimate pressures that will be generated by the apparatus during heating. This initial gas pressure in the diaphragm can be controlled by controlling the temperature and pressure at which the diaphragm sealing is performed. As an alternative, the diaphragm 10 may have a gas container attached thereto for changing the pressure in the diaphragm for different substrate sintering applications.

It should be noted that the volume between the planar major surfaces 14 and 16 of the base 12 is designed to be substantially less than the volume in the container 20. Thus, a high percentage of the original gas volume in the diaphragm 10 is held by the container 20. Typically, the diaphragm may be designed so that the base volume between the two major surfaces 14 and 16 at room temperature is approximately zero, i.e., the surfaces or discs 14 and 16 are touching. Note that FIG. 1A shows these major surfaces 14 and 16 as being apart, for purposes of drawing clarity. At a temperature of 1000° C., the base volume may be approximately 10% of the volume of diaphragm. This base expansion is indicated by dashed lines 50 in FIG. 1A and is exaggerated in FIG. 1C for purposes of drawing clarity.

The diaphragm 10 of FIG. 1 can be formed by way of example, simply by grooving the perimeter of two flat sheet metal discs with a machined mold at high temperature. The resulting grooved discs can be gas loaded and then welded or crimped together along their perimeters to form a hermetic seal. Typical dimensions for the diaphragm might comprise a disc base radius $R_1$ of 12 mm and a toroid container minor radius $R_2$ of 8 mm.

The diaphragm apparatus of the present invention is shown in combination with a frame structure 30 with a sintering cell 28 disposed therein for loading. The sintering cell 28 may comprise simply one or more ceramic substrates to be sintered or fired. In the alternative, the sintering cell 28 may comprise one or more ceramic substrates to be sintered, with specially designed platen layers disposed above and below each ceramic substrate in order to obtain desired processing results. For example, co-pending application Ser. No. 859,093 filed May 2, 1986 discloses the use of porous platens above and below each ceramic substrate to maintain a controlled oxygen potential across the surface of the substrate to enhance binder burn-off. These platens may include shallow grooves to facilitate the release of gas during the ceramic substrate firing.

Figure 2:
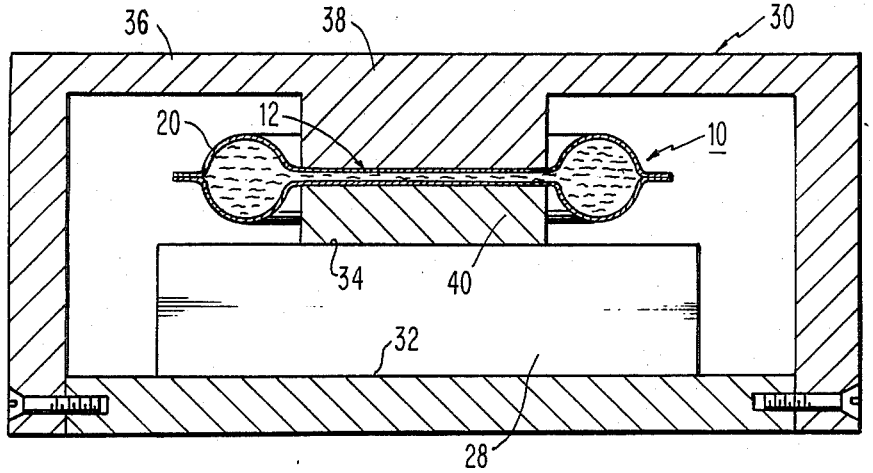
FIG. 2 is a sectioned side view of the diaphragm-frame structure of the present invention.

The purpose of the frame structure 30 is to provide a means for translating the force of the expanding gas in the diaphragm 10 to the sintering cell 28. This frame structure may be designed to take a variety of configurations to achieve this force translating function. In the embodiment shown in FIG. 2, the frame structure 30 comprises a first planar surface 32 adapted for holding one of the major surfaces of the substrate-containing cell 28, and further includes a second planar surface 34 opposing the first planar surface, with this second planar surface 34 adapted for making contact with one of the two planar major surfaces 14 or 16 of the base 12. Additionally, this frame structure 30 is specially designed so that the hollow container 20 is not in contact with the frame structure 30. In the embodiment shown in FIG. 2, the frame structure 30 comprises an outer frame structure shell 36 with a first pedestal 38 formed at the top of the outer frame structure and comprising the second planar surface 34 of the frame structure thereon. The frame structure 30 further comprises a second pedestal 40 disposed between the other of the major surfaces of the substrate-containing cell 28 and the other of the two planar major surfaces 14 or 16 of the base 12. This second pedestal 40 is disposed so that it is not in contact with the hollow container 20. This frame structure 30 causes any pressure arising from the expansion of the diaphragm base 12 to be exerted against the substrate-containing cell 28.

It should be noted that the frame structure could also simply be comprised of the ceiling and floor of a sintering furnace.

As discussed previously, the function of the diaphragm 10 is to apply a predetermined pressure to the substrate-containing cell 28 during sintering. A gas-loaded diaphragm of the type shown in FIG. 1 filled with inert gas at atmospheric pressure and room temperature will function to apply a pressure of $55\pm5$ psia to the substrate-containing cell 28 at a temperature of 1000° C. In essence, this diaphragm pressure is exerted in accordance with the standard gas law $P=NRT/V$, where P is the pressure, N is the number of moles of gas in the diaphragm 10, R is the gas constant, T is the gas temperature, and V is the volume of the diaphragm 10. As noted previously, the volume between the planar major surfaces 14 and 16 of the base 12 is substantially less, i.e., at least 75% less than the volume in the toroidal-gas-filled container 20. Accordingly, a high percentage of the original gas volume in the diaphragm 10 is held by the container 20. This volumetric differential in the diaphragm in combination with the fact that the container 20 has an essentially circular cross-section so that it has a very low tendency to deform, ensures that only a minimal volume change occurs with increasing gas temperatures in the diaphragm 10. Accordingly, with this design the pressure of the gas in the diaphragm 10 is essentially proportional to the temperature T. However, an increased temperature of the gas in the diaphragm 10 does cause the planar major surfaces 14 and 16 of the base to pull apart by a certain predetermined small amount to thereby exert pressure on the substrate-containing cell 28. This volume change for the gas-filled base is so small relative to the entire gas volume in the diaphragm (which is held primarily in the container 20), that the volume change can be considered to be nominal. Thus, the pressure being exerted by the planar major surfaces 14 and 16 of the base 12 can be accurately determined by measuring the temperature of the gas. Essentially, the pressure exerted on the substrate-containing cell 28 is equal to the pressure inside the diaphragm 10 times the area of the base 12 divided by the area of the substrate-containing cell 28.

It should be noted that there is a certain amount of z-direction (thickness) shrinkage which occurs for most ceramic substrates during firing and sintering. This z-direction shrinkage can be compensated for by tailoring the volume enclosed by the container 20 of the diaphragm 10. One method for tailoring this container 20 volume is by designing the diaphragm 10 in accordance with the equation $0.25\pi R_2^2/R_1 \geqq$ shrinkage (mm). In this equation, $R_1$ is the disc radius for the base 12, while $R_2$ is the radius for the circular container 20 (the minor radius for the toroid).

The present invention comprises an apparatus for applying a load to a substrate-containing cell in a furnace. This apparatus, when filled with gas at atmospheric pressure and room temperature, can exert a pressure up to 60 psia. Accordingly, this apparatus with this amount of gas loading is especially suited for use in applying pressure for sintering glass/ceramic with copper impurities.

As noted previously, the present apparatus may be tailored to exert a desired pressure at a particular temperature simply by changing the gas loading parameters utilized, i.e., the gas loading temperature and pressure. Likewise, the radius of the base 12 can be tailored according to the required total weight loading needed for the conformal sintering or firing in accordance with the product size. Likewise, the volume enclosed by the container 20 can be specially tailored to compensate for glass ceramic shrinkage during sintering.

The present apparatus is specially designed to minimize volume changes in the diaphragm 10 as the temperature of the gas therein is increased. This volume change minimization ensures that the pressure of the gas in the diaphragm 10 is approximately proportional to the temperature T in the diaphragm. In a preferred embodiment of this apparatus/design, the diaphragm comprises a central base composed of two opposing discs surrounded on their perimeter and connecting to a toroidal gas-filled container structure. There is essentially zero volume between the discs forming the base at atmospheric pressure and room temperature. The volume of the base at the sintering temperature is designed to be only approximately 10% of the volume of the container 20 to obtain this volume change minimization.

The apparatus of the present invention can be utilized in a frame structure to apply a force on a substrate-containing cell to counter-act the cohesive forces of sintering to thereby prevent shrinkage in the x-y plane thereof. The present apparatus has a very low thermal mass and can thus be heated very quickly with a small amount of energy. Additionally, the present apparatus is not cumbersome, and does not have a high center of gravity which would cause stability problems in conveying the substrate-containing cell to and from the sintering furnace.

While the present invention has been particularly shown and described with reference to preferred embodiments therefor, it will be understood by those skilled in the art that the foregoing and other changes in form and detail may be made therein without departing from the spirit and scope of the present invention.

We claim:

1. An apparatus for applying pressure to a substrate-containing cell with two opposing major surfaces during a heating cycle, comprising;

a frame with a first and second opposing planar surfaces, with said first surface being adapted for holding one of the major surfaces of said substrate-containing cell thereon; and a sealed gas-filled substantially hollow diaphragm for exerting a pressure substantially only proportional to a desired temperature including an approximately planar hollow base with two opposing planar major surfaces substantially in contact thereacross at ambient temperature, and a gas-filled substantially hollow container with a cross-section having at least one substantially circular area connected to communicate with said hollow base so that gas can flow therebetween, with said sealed gas-filled diaphragm being disposed with one of the two planar major surfaces of said base in contact with said second opposing planar surface of said frame, but being disposed so that said hollow container is not in contact with said frame, and with said diaphragm being disposed in relation to said frame and said cell so that when said diaphragm is heated to a desired temperature, the gas in said diaphragm expands and forces said two opposing planar major surfaces of said base apart to thereby exert a predetermined pressure that is substantially only proportional to said desired temperature on said substrate-containing cell.

2. An apparatus as defined in claim 1, wherein at least one cross-section of said hollow container of said diaphragm comprises two different substantially circular areas.

3. An apparatus as defined in claim 2, wherein said base has a volume between said two planar major surfaces thereof which is less than 15% of the volume of said gas-filled container when said diaphragm is heated to said desired temperature.

4. An apparatus as defined in claim 1, wherein said hollow container of said diaphragm has at least one cross-section thereof with two substantially circular areas disposed at and communicating with opposite ends of said planar base.

5. An apparatus as defined in claim 1, wherein said hollow container is disposed around and connects to the perimeter of the planar major surfaces of said base to thereby communicate with said base around the perimeter thereof.

6. An apparatus as defined in claim 5, wherein said frame comprises;

an outer frame structure with said second planar surface disposed on a first pedestal; and a second pedestal disposed between the other of the major surfaces of said substrate-containing cell and the other of said two planar major surfaces of said base, but disposed so that it is not in contact with said hollow container.

7. An apparatus as defined in claim 1, wherein said two opposing planar major surfaces of said base comprise opposing planar discs, and wherein said hollow container is substantially in the shape of a toroid disposed around and connected to the disc perimeter of said base to thereby communicate with said base around the perimeter thereof.

8. An apparatus as defined in claim 7, wherein said frame comprises;

an outer frame structure with said second planar surface disposed on a first pedestal; and a second pedestal disposed between the other of the major surfaces of said substrate-containing cell and the other of said two planar major surfaces of said base, but disposed so that it is not in contact with said hollow container.

9. An apparatus as defined in claim 1, wherein said frame comprises the walls of a furnace system.

10. An apparatus as defined in claim 1, wherein said sealed gas-filled diaphragm contains a gas therein, which at room temperature has a pressure which is different than atmospheric pressure.

11. An apparatus as defined in claim 7, wherein said base disc has a radius $R_1$ (mm) and wherein said toroid has a minor radius $R_2$ (mm) and wherein $R_2$ and $R_1$ are designed so that $0.25\pi R_2^2/R_1 \geqq$ shrinkage (mm), where the shrinkage is the shrinkage of the substrate in the thickness dimension.

* * * * *